United States Patent [19]

Fazzina

[11] 4,443,833

[45] Apr. 17, 1984

[54] FLASHLIGHT

[76] Inventor: S. Harry Fazzina, 8411 Widener Rd., Wyndmoor, Pa. 19118

[21] Appl. No.: 473,080

[22] Filed: Mar. 7, 1983

[51] Int. Cl.[3] ..... F21L 7/00

[52] U.S. Cl. ..... 362/189; 362/202; 362/204; 362/205

[58] Field of Search ..... 362/189, 202, 204, 205; 60/200

[56] References Cited

U.S. PATENT DOCUMENTS

| | | | |
|---|---|---|---|
| 4,122,510 | 10/1978 | Halliday | 362/189 |
| 4,210,953 | 7/1980 | Stone | 362/189 |
| 4,242,724 | 12/1980 | Stone | 362/189 |

*Primary Examiner*—Stephen J. Lechert, Jr.
*Attorney, Agent, or Firm*—John W. Logan, Jr.; Arthur R. Eglington

[57] ABSTRACT

A flashlight in accordance with the preferred embodiment of the invention includes a housing enclosing an insulating battery retaining member formed with spring arms for retaining a pair of batteries in spaced-apart relationship. Further included is a light bulb having a conductive support element one leg of which is in electrical contact with the surface of one battery while being maintained in fixed space relation between the retaining housing and the other positive battery post, as to the other leg. Adjacent the opposite end of the housing a conductive switch member is frictionally retained on the positive post of one battery and extends between the battery retaining member and a flexible wall of the housing. The other end of the switch member is located adjacent a cutout portion of the battery retaining member which exposes a conductive surface of the other of the batteries so that when the flexible wall of the housing is pressed, the free end of the switch member contacts the other of the batteries completing a circuit between the batteries and the light bulb.

3 Claims, 4 Drawing Figures

FLASHLIGHT

Figure 1:
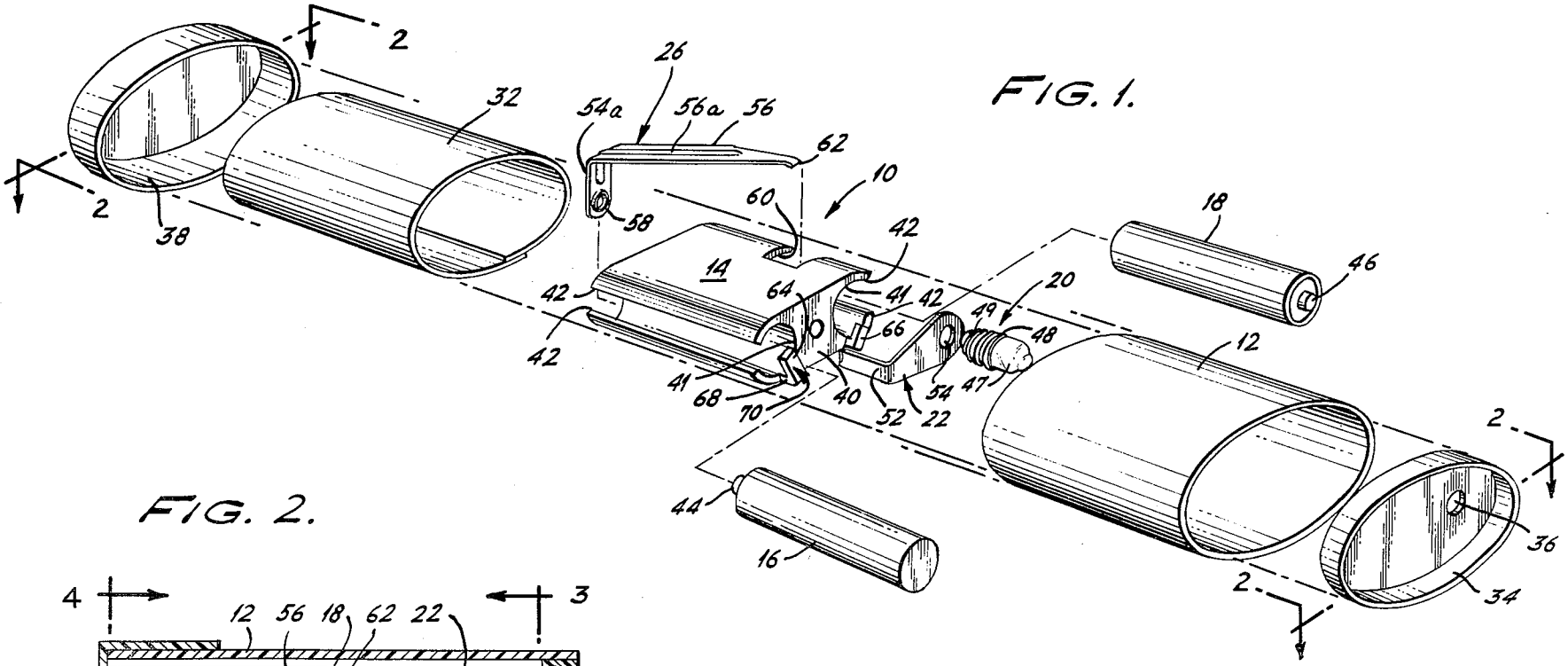

This invention relates to flashlights and, more particularly to relatively small, inexpensive flashlights easily carried in a purse or pocket. One flashlight of this type is generally similar to that disclosed in U.S. Pat. No. 4,122,510, issued June 23, 1978, to R. L. Halliday and comprises a housing having a flexible wall in which is carried a battery holder formed with shallow channels in which a pair of batteries are adhesively secured. A light bulb is carried at one end of the housing and includes a support member extending from the bulb which is in contact with conductive portions of one of the batteries. One end of a conductive switch member is frictionally retained on the positive post of one of the batteries and the other end of the switch member is arranged to be adjacent to, but normally spaced from, an exposed conductive surface of the other battery. When it is desired to light the bulb, the outer flexible wall of the housing is pressed or squeezed causing the other end of the switch wire to contact the exposed surface of the other battery completing the circuit between the batteries and the bulb. While the flashlight described iis generally satisfactory in use, it is time consuming and, thus, expensive to manufacture, particularly as to a need to have a custom bulb base with brittle lead wires bonded thereto.

Accordingly, it is an object of this invention to provide a small, easily carried flashlight that is relatively inexpensive to construct and has durable components.

It is another object of this invention to provide a small flashlight that is easily assembled from standard parts.

It is yet another object of this invention to provide a small flashlight including economical battery holding means and reliable switch means.

Finally, it is an object of this invention to provide a small flashlight that is relatively simple, rugged and easy to use.

These and other objects of this invention are accomplished by providing a flashlight comprising a housing having a generally flexible side wall, an insulating battery retaining member located in the housing and formed with resilient arm members which retain a pair of batteries having exposed conductive surfaces. At one end of the housing is carried a light bulb having a conductive support element, one leg of which is an electrical contact with the surface of one battery, while the other leg is maintained in spaced relation between the one end wall and the other battery post. Frictionally retained on one of the batteries is a conductive switch member that extends from the one battery post between the battery retaining member and the flexible side wall of the housing. The switch member terminates adjacent a cutout portion of the battery retaining member which exposes a conductive surface of the other battery.

More particularly, the switch member is formed of a flat piece of material bent adjacent one end to provide a long leg portion and a short leg portion, the latter formed with an opening which is placed over the positive post of the one battery and frictionally retained thereon. The long leg portion extends from the short leg portion to the cutout portion of the battery retaining member.

Further, there is provided a pair of stop members also formed of insulating material and bearing on the ends of the batteries adjacent the one end of the housing to retain the batteries against movement in one direction along the housing.

Figure 2:
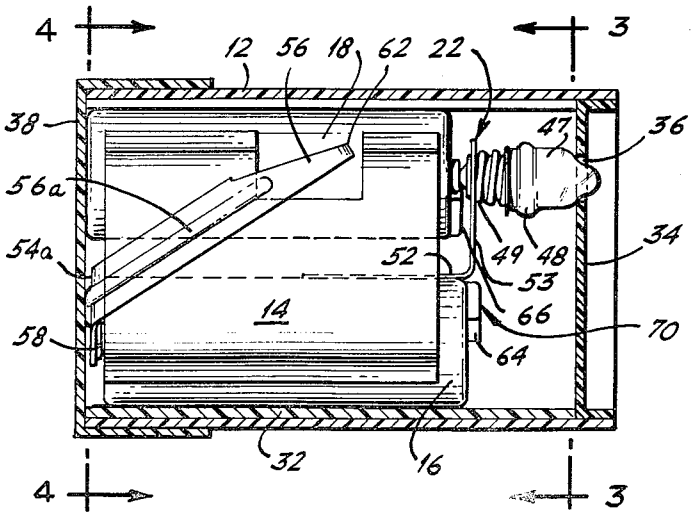
Figure 3:
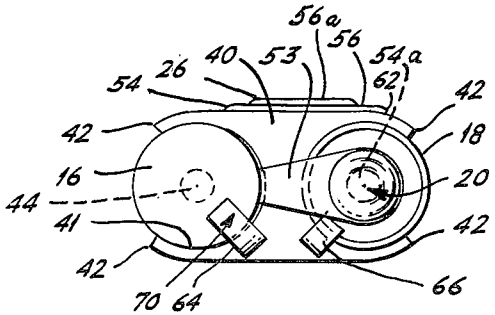
Figure 4:
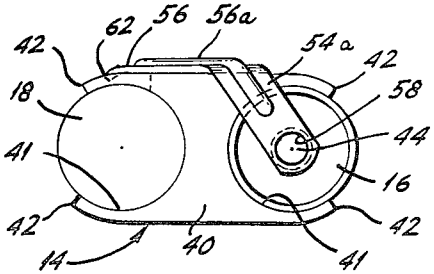

For a better understanding of the invention, reference is made to the following description of a preferred embodiment thereof taken with the figures of the accompanying drawing, in which:

FIG. 1 is an exploded perspective view of a flashlight in accordance with this invention;

FIG. 2 is a partial sectional view of the flashlight illustrated in FIG. 1 shown in assembled condition; and, FIGS. 3 and 4 are sectional view of the flashlight with the housing omitted for the sake of clarity and taken generally along the lines 3—3 and 4—4, respectively, of FIG. 2.

Referring now to the drawing, there is illustrated a flashlight 10 comprising a housing with a generally flexible side wall 12 in which is carried a battery retaining member 14 for a pair of batteries 16 and 18 having exposed conductive surfaces. One end of the housing carries a light bulb 20 including conductive support element 22 extending from the bulb into conducting relationship with the battery 16. A switch member 26 is frictionally retained with the battery 16 and extends upwardly along the outer surface of the battery retaining member 14 adjacent the side wall 12 and terminates adjacent a cutout portion of the retaining member formed adjacent to an exposed conductive surface of the battery 18.

As noted above, the housing includes a generally flexible side wall 12 which in the preferred embodiment disclosed herein comprises the outer wall member of the housing and surrounds a flexible inner wall member 32. Both wall members are generally rectangular pieces of plastic coated paper or some other similar flexible insulating material, and are shaped to define a generally oval cross-section cavity. The outer wall member 12 is preferably transparent and the inner wall member 32 is opaque and may include indicia of any desired type, for example, advertising material.

At the end of the wall members 12 and 32 adjacent the light bulb 20 there is provided a generally oval end wall member 34 adapted to seat against the inner surface of the outer wall member 12 and on the end of the inner wall member 32. The end wall member 34 is retained in position by friction, or adhesives, can be heat fused or retained in any other desirable manner. An opening 36 is eccentrically formed in the end wall member and the light bulb 20 is adapted to project through the opening. This opening is axially aligned with the positive post 46 on battery 18. If desired, the top outer surface of the end member 34 may be coated with a reflective material for dispersing and reflecting the light from the light bulb 20. The other ends of the inner and outer wall members 12 and 32, respectively, are received in an end closure member or cup 38 which is retained in place by friction or adhesives, or be heat fused or retained in any other desirable manner.

The battery retaining member 14 is located inside the general oval cavity, is formed of plastic or a similar resilient insulating material and comprises a central body portion 40 extending longitudinally along the axis of the flashlight 10. Opposite sides of the body portion 40 are formed with arcuate surfaces 41 which provide seats for the batteries 16 and 18. For retaining the batteries 16 and 18 in the seats 41, a pair of generally arcuate resilient arms 42 extend from each of the opposite sides of the body portion 40 and form with the adjacent seat 41, a channel having an arcuate length greater than one-half the circumference of a battery. The resilient arms 42 are generally elongated extending throughout the length of the body portion 40 and the longitudinal ends of each arm in a pair are spaced apart a sufficient distance to allow insertion of a battery in an insulating enclosure.

The batteries 16 and 18 are generally conventional dry cell batteries, without an insulating wrapper around the outer surface or casing, so that their conductive cylindrical walls are exposed. The batteries are arranged in the retaining member 14 so that the flat end wall of the battery 16 is adjacent the end wall member 34 and the positive post 44 is adjacent the cup 38, and so that the flat end wall of the battery 18 is adjacent the cup 38 and the positive post 46 is adjacent the end wall member 34.

The light bulb 20 is conventional having a dome portion 47, an enlarged mounting portion 48, and a reduced diameter, conductive socket portion 49.

As better seen in FIG. 2 of the drawing, the bulb socket 49, which has a conventionally spiralled, external ridge configuration, extends inwardly to make a conductive contact with positive post 46 of battery 18. The socket is held continuously against the post by being retained in one face of an elbow-shaped elongated member of electrically conductive support 22, like of a suitable metal, which has an appropriate length. The other leg 52, preferably having a curved surface, is pressure fitted between curved seat 41 and the cylindrical wall of battery 16, thus positioning the socket-retaining leg 53 in a parallel spaced relationship to the end face of body portion 40. Leg 53 is formed with an aperture 54, which threadedly receives and takes up till locking the bulb socket 49; it thus retains that socket in continuous contact with battery post 46, while the dome portion 47 extends outwardly of aperture 36 in end wall member 34.

Because the resilient arms 42 retain the batteries in contact with their adjacent seat 41, the retaining force maintains conductive contact between the battery 16 and curved leg 52 of conductive member 22.

The switch member 26 is formed from a flat elongated piece of electrically conductive material, for example, any suitable metal, and, accordingly, has a measurable length and width. The flat piece of material is angularly bent adjacent one end so that it includes a short leg portion 54*a* and a long leg portion 56, forming a right angle in the side view, but extending at an obtuse angle in the front view. Leg 56 is provided with an embossed longitudinal rib 56*a* providing resiliency of the leg which is subjected to repeated flexing in the course of actuating the flashlight. The short leg portion 54*a* is formed with a small aperture 58 which frictionally fits over the positive post 44 of the battery 16. Preferably, the aperture 58 is formed inwardly by a suitable piercing tool so that a small cylindrical sleeve extends from the surface of the short leg portion 54 in the direction of the long leg portion 56 while the sleeve frictionally grips the positive post 44.

Since the long leg portion 56 extends, in the front view, at an obtuse angle to the short leg portion 54, it extends between the battery retaining member 14 and the inner surface of the inner wall member 32 toward the battery 18 and terminates in a free end adjacent a cutout portion 60 formed in the one of the arms 42. Thus, the free end of the long leg portion 56 is adjacent the exposed conductive surface of the battery 18 and is normally spaced therefrom by the thickness of the arm 42. If desired, the free end can be formed with a tongue 62 extending away from and then toward the exposed conductive surface of the battery 16.

When the flashlight is assembled and when it is desired to light the light bulb 20, it is merely necessary to squeeze the opposite sides of the outer wall member 12. The force thus exerted moves the inner wall member 32 toward the batteries 16 and 18 exerting force on the switch member 26 whereby the free end of the long leg portion 56 contacts the exposed conductive surface of the battery 18 completing the electrical circuit between the batteries 16 and 18 and energizing the light bulb 20.

At the end of the battery retaining member 14 adjacent the end wall member 34, there is provided a pair of stop members 64 and 66 formed integral with the body portion 40. The stop member 64 is generally L-shaped including a first leg portion 68 projecting outwardly of the body portion in a direction parallel to the battery 16 and also including a second leg portion 70 extending across a portion of the oval channel formed by the seat 41 and arms 42, 42 in which the battery 16 is received. the second leg portion 70 thus bears on the flat end wall of the battery 16 and prevents axial movement of that battery toward the light bulb. With any such movement of the battery 16 thus prevented, the switch member 26 cannot be inadvertently disengaged from the positive post 44 of the battery.

The stop member 66 comprises a single leg portion extending across the oval channel formed by the seat 41 and arms 42,42 in which the battery 18 is received. This single leg portion thus bears on the end of the cylindrical wall of the battery 18 adjacent the positive post 46, and prevents axial movement of that battery toward the light bulb 20. That contact is accomplished by the take-up of lamp socket 49 within opening 54.

At this point it is noted that the cylindrical walls of the batteries 16 and 18 have a slightly larger axial length than that of the body portion 40 and arms 42,42. Accordingly, a portion of the cylindrical wall and the flat end wall of the battery 18 project beyond the end of the battery retaining member 14 adjacent the cup member 38 and the flat end wall of that battery member bears on the inner surface of the cup member. It is also noted that the length of the first leg portion 68 of the stop member 70 is such, that a portion of the cylindrical wall and flat end wall of the battery 16 project beyond the end of the battery retaining member 14 adjacent the wall member 34. The length of the projection of the cylindrical wall of the battery 16 is equal to the length of the projection of the cylindrical wall of the battery 18, so that the end of the positive post 44 lies in the same plane as the end wall of the battery 18. Accordingly, the inner surface of the cup member 38 bears on the flat end wall of the battery 18 and the end of the positive post 44 and is maintained in a level orientation on the side wall 12.

While in the foregoing, a preferred embodiment of the invention has been described, it should be understood to one skilled in the art that various modifications and changes can be made without departing from the true spirit and scope of the invention as recited in the appended claims.

I claim:

1. A flashlight comprising: a housing having (a) a generally flexible side wall;

(b) a first end wall;

(c) a second end wall having an off-center opening therein;

(d) an insulating, battery retaining member including resilient arm members adapted for retaining a pair of batteries having exposed conductive surfaces;

(e) one of said batteries projects beyond the end of said battery retaining member adjacent said one end of said housing and wherein the other of said batteries projects beyond said battery retaining means adjacent said other end of said housing, and wherein said projecting portions are equal, whereby said positive post and the flat end wall of said other of said batteries path lie the same plane;

(f) a light bulb at the end of said housing adjacent said second end wall with a portion of said light bulb extending through said off-center opening, said light bulb being electrically connected to one of said batteries;

(g) a conductive member having an elbow-shaped configuration with one leg being frictionally retained between the conductive surface of said other battery and its adjacent battery retaining member and with the other leg being in fixed contact with the conductive socket of said light bulb, and is further provided with an aperture in the leg adjacent the lamp socket adapted to rotatably receive and take up said socket, which bulb itself is provided with a spiralled ridge configuration to threadedly engage said aperture; and (h) a conductive switch member having one leg frictionally retained on said positive post of said other battery, said switch member including a second leg portion extending between said flexible side wall and said battery retaining member and terminating adjacent a cutout portion of said battery retaining member, exposing a conductive portion of the other of said batteries, whereby said switch member completes a circuit between said batteries and said light bulb when compression is applied to the flexible side wall.

2. A flashlight in accordance with claim one wherein the conductive leg contacting the one battery surface is provided with an arcuate surface to improve the electrical conductivity of its frictional retention.

3. A flashlight in accordance with claim one wherein there is provided a pair of stop members formed on said battery retaining member at the end thereof adjacent said second end wall, each stop member bearing on the end of a battery member for preventing movement of said battery members toward said second end wall.

* * * * *